US010737308B2

(12) United States Patent
Masek et al.

(10) Patent No.: US 10,737,308 B2
(45) Date of Patent: Aug. 11, 2020

(54) METHOD OF PRODUCING HOLLOW OBJECTS AND AN ARRANGEMENT FOR SUCH METHOD

(71) Applicant: Západoceská univerzita v Plzni, Plzen (CZ)

(72) Inventors: Bohuslav Masek, Kaznejov (CZ); Hana Jirková, Plzen (CZ); Ctibor Stadler, Plzen (CZ)

(73) Assignee: Zapadoceska Univerzita v Plzni, Plzen (CS)

( * ) Notice: Subject to any disclaimer, the term of this patent is extended or adjusted under 35 U.S.C. 154(b) by 308 days.

(21) Appl. No.: 15/703,318

(22) Filed: Sep. 13, 2017

(65) Prior Publication Data

US 2018/0078987 A1 Mar. 22, 2018

(30) Foreign Application Priority Data

Sep. 19, 2016 (CZ) ..... 2016-574

(51) Int. Cl.
*B21D 26/033* (2011.01)
*B21D 26/047* (2011.01)
(Continued)

(52) U.S. Cl.
CPC ..... *B21D 26/033* (2013.01); *B21D 26/027* (2013.01); *B21D 26/029* (2013.01);
(Continued)

(58) Field of Classification Search
CPC .. B21D 26/033; B21D 26/049; B21D 26/045; B21D 26/047; B21D 26/041;
(Continued)

(56) References Cited

U.S. PATENT DOCUMENTS 5,916,317 A * 6/1999 Willoughby ..... B21D 26/049 29/421.1
6,261,392 B1 * 7/2001 Sundgren ..... B21D 26/033 148/590

(Continued)

FOREIGN PATENT DOCUMENTS

CZ 302917 B6 1/2012
CZ 303949 B6 7/2013

(Continued)

OTHER PUBLICATIONS

Trindade Filho et al., Normalizing Heat Treatment Effect on Low Alloy Steel Weld Metals, Published in 2000 (Year: 2019), 5 Pages Total.*

(Continued)

*Primary Examiner* — Teresa M Ekiert
*Assistant Examiner* — Sarkis A Aktavoukian
(74) *Attorney, Agent, or Firm* — Hovey Williams LLP

(57) ABSTRACT

A method of, and arrangement for, producing shaped hollow metal objects by a hot process. A metal hollow semi-finished-product with at least one opening is heated to a forming temperature and placed into a cavity, whose shape corresponds to the desired final external shape of the hollow object. Then the cavity is sealed and water and/or steam is introduced therein. After the final shape of the semi-finished-product is achieved, the semi-finished-product is removed. The cavity is formed by a split mould, whose opening's entry edge has an expanded portion, against which a sealing feature is oriented. The outer surface of the sealing feature is arranged to close against this expanded portion. The sealing feature is also provided with a means of supply of water and/or steam, and a tube through which the water and/or steam is supplied. This tube extends into the (Continued)

Figure 1:
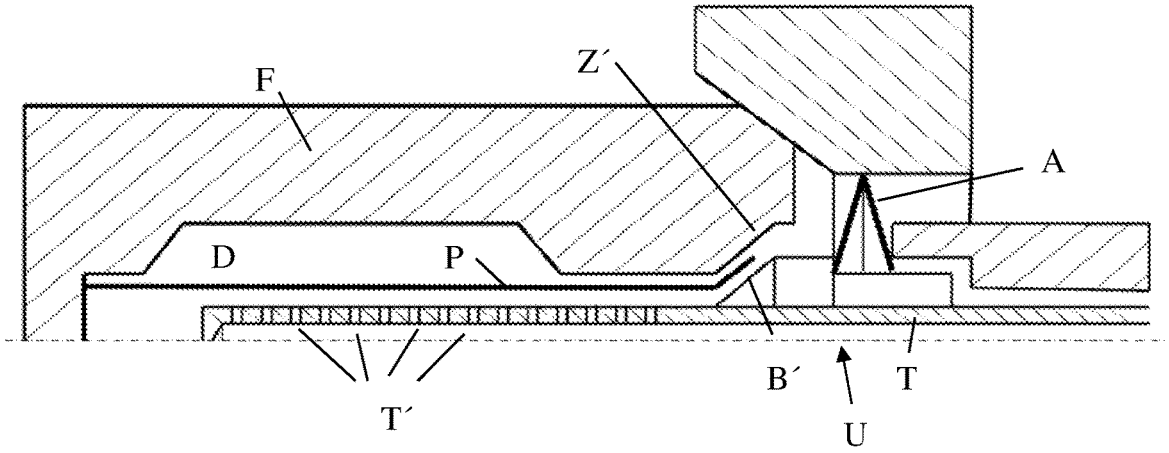

interior space of the semi-finished-product, and can be provided with nozzles.

11 Claims, 1 Drawing Sheet

(51) Int. Cl.
*B21D 26/041* (2011.01)
*B21D 26/049* (2011.01)
*B21D 26/027* (2011.01)
*B21D 26/029* (2011.01)
*B21D 26/031* (2011.01)

(52) U.S. Cl.
CPC ..... *B21D 26/031* (2013.01); *B21D 26/041* (2013.01); *B21D 26/047* (2013.01); *B21D 26/049* (2013.01)

(58) Field of Classification Search
CPC ..... B21D 26/02; B21D 26/00; B21D 26/027; B21D 26/029; B21D 26/031
See application file for complete search history.

(56) References Cited

U.S. PATENT DOCUMENTS

| | | | | |
|---|---|---|---|---|
| 6,349,583 | B1 | 2/2002 | Kleinschmidt et al. | |
| 7,392,679 | B1 * | 7/2008 | Ghiran | B21D 26/045 29/421.1 |
| 7,685,856 | B1 * | 3/2010 | Ghiran | B21D 26/045 29/421.1 |
| 8,852,367 | B2 | 10/2014 | Masek et al. | |
| 2004/0200550 | A1 * | 10/2004 | Pfaffmann | B21D 26/033 148/526 |
| 2005/0186302 | A1 * | 8/2005 | Sohn | B21D 26/033 425/392 |
| 2006/0060601 | A1 * | 3/2006 | Kubacki | B21D 22/125 222/1 |
| 2009/0229333 | A1 * | 9/2009 | Jensen | B21D 26/027 72/60 |
| 2011/0023568 | A1 | 2/2011 | Yamamoto et al. | |
| 2013/0081741 | A1 | 4/2013 | Masek et al. | |
| 2016/0101456 | A1 * | 4/2016 | Sikora | B21D 26/033 72/61 |

FOREIGN PATENT DOCUMENTS

| | | | | |
|---|---|---|---|---|
| EP | 0930109 | A2 | 7/1999 | |
| EP | 1063029 | A1 | 12/2000 | |
| EP | 1306145 | A1 | 5/2003 | |
| FR | 1056298 | A * | 2/1954 | |
| GB | 392635 | A * | 5/1933 | B21D 15/00 |
| KR | 20140002264 | A | 1/2014 | |

OTHER PUBLICATIONS

Machine Translation of FR-1056298-A, Kranenberg, Publication Year 1954, Total Pages 11 (Year: 2020).*

Search Report from Corresponding Czech Application No. PV 2016-574 dated Apr. 13, 2017 (3 pages).

Gearing, David; Turning Up the Heat on Tube Hydroforming; http://www.interlaken.com/wp-content/uploads/2015/03/TurningUpTheHeatOnTubeHydroforming1.pdf; TPA Publication; The Tube & Pipe Journal; Oct./Nov. 2013, pp. 34-37 (4 pages).

Fatemi, A. et al., The Effect of Tube Material, Microstructure, and Heat Treatment on Process Responses of Tubehydroforming Without Axial Force; Int J Adv Manuf Technol (2013) 68: 263. https://doi.org/10.1007/s00170-013-4727-1; pp. 263-276 Abstract Only.

* cited by examiner

METHOD OF PRODUCING HOLLOW OBJECTS AND AN ARRANGEMENT FOR SUCH METHOD

TECHNICAL FIELD

This invention relates to a method of producing hollow objects of metals by a hot process and an arrangement for such method.

BACKGROUND ART

Hollow objects promise a considerable potential for use in lightweight structures. In their technical applications, the weight of the material is utilized more efficiently for providing the desired function. Besides hollow objects in which the presence of a cavity is the necessary condition, e.g. in the design of piping, pressure vessels, heat exchangers or springs, the number of applications has been increasing recently in which a cavity is predominantly a feature that provides weight savings, including the aspect of the moment of inertia. Hollow rotating shafts may serve as an example. They have much lower mass than identical solid shafts. Yet, such hollow shafts can transmit a comparable torque at identical outside dimensions. In addition, their acceleration and deceleration require much less energy, owing to their lower moment of inertia. The better the mechanical properties of material, the thinner the wall can be—and the higher the efficiency of the mass of the structural element.

Hollow objects made of steels must be first converted to the required shape and then, in order to obtain excellent properties, heat treated to impart high strength and sufficient toughness. The shape of such a semi-finished product can be obtained by various methods, e.g. machining, forming or welding.

The weakness of the existing method of making hollow objects or semi-finished products is that it is problematic, technically demanding, complicated in materials terms and costly to achieve their desired shape and optimum properties. Moreover, conventional machining methods generate large quantities of waste in the form of chips. Conventional combinations of forming or other methods with subsequent treatment require multiple heating operations resulting in higher overall energy consumption in production. Some complex shapes, such as those without rotational-symmetry and with other than straight axis, are even impossible to manufacture by conventional methods. Prior art includes, for example, Czech Republic Patent No. 302917, which describes a method of manufacture of high-strength objects of multiphase martensitic steels. Making a hollow object comprises a heating process, a forming process and a cooling process. The input semi-finished product is heated to an austenite temperature of the material of which the semi-finished product is made, the semi-finished product is then converted to the final shape of the hollow object in a forming device and immediately after that this object is cooled to a temperature, at which incomplete transformation of austenite to martensite takes place. Immediately thereafter, retained austenite stabilization is effected in a heating device by way of diffusion-based carbon partitioning within the material from which the hollow object is made. Once the stabilization is finished, the hollow object is cooled in a cooling device to ambient temperature.

DISCLOSURE OF INVENTION

The present invention relates to a method of producing shaped hollow objects of metals by a hot process and an arrangement for such method. The method of making shaped hollow objects of metals by a hot process is characterized by heating a metal hollow semi-finished product with at least one opening to a forming temperature which is equal to an austenite temperature of the material of which the semi-finished product is made.

In one embodiment, the heating device can comprise a device capable of providing induction heating but the semi-finished product may also be heated in a furnace.

The semi-finished product is placed into a cavity whose shape corresponds to the desired final external shape of the hollow object. The cavity is then sealed and a medium in the form of water, steam or a mixture of water and steam is introduced into the cavity. The cavity is formed by a mould, whose opening's entry edge has an expanded portion, against which a sealing feature is oriented. The outer surface of said sealing feature is arranged to close against this expanded portion, and this sealing feature is provided with a means of supply of a medium. This sealing feature is provided with a tube through which the means of supply of medium passes. The tube extends into the interior of the semi-finished product. Once the final shape of the semi-finished product is achieved, the cavity opens, the semi-finished product is removed and cools down.

Owing to the contact between the medium and the semi-finished product, the material cools gradually and no transformation occurs until the forming process is finished. Thus, the entire forming process takes place in austenite condition. Once the semi-finished product comes into contact with the mould wall, the material cools further. This process can be applied several times, until the mould contour is filled completely. Simultaneously, the mould may be heated, by which means the cooling of the formed hollow object can be stopped at a desired temperature. Thus, microstructural evolution can be controlled to achieve austenite transformation to martensite or bainite or ferrite. At the same time, part of austenite may remain untransformed due to interrupted cooling. At this temperature, the hollow object is removed from the mould and, depending on the type of desired microstructure, either controlled cooling to ambient temperature or, alternatively, holding at a defined temperature is carried out which leads to partitioning of elements, most notably carbon, in the microstructure. This leads to stabilisation of retained austenite and relieves stress in hardening microstructures, i.e. bainite and, above all, martensite. As a result, ductility and toughness improve. This hold is followed by cooling to ambient temperature. Depending on the treatment profile chosen, the resultant microstructure may contain hardening phases comprising martensite and bainite, and metastable austenite, and, if required, the microstructure may also contain ferrite.

Advantageously, forming process in the hollow object may be effected by means of steam pressure. Steam is generated by evaporation of water which is supplied by means of a tube into the space in the cavity of semi-finished product being formed. It is advantageous when the circumference of the tube is provided with nozzles for distributing the steam pressure more uniformly. In order to support intensive generation of steam and to achieve the required pressure, the tube may be preheated to a temperature of approximately 200° C. Water mist or steam from the nozzles hits the heated inner wall of the hollow semi-finished product, which causes steam to be generated and steam pressure to build up.

In addition to securing the position of the semi-finished product, the sealing feature, which comprises a tube, also forms a seal for the mould so that the steam pressure in the cavity rises to a level which permits the semi-finished product to expand inside the mould. The inner pressure causes the semi-finished product to be shaped perfectly by a hot or warm process until the semi-finished product comes into contact with the mould wall.

In order to seal the dies, the sealing feature may be advantageously pressed via a spring which, when maximum pressure is exceeded, separates the sealing feature's outer surface, which is arranged to close against the expanded portion of the entrance edge of the die opening, from this expanded portion and the gap thus provided enables a part of the pressurized steam to be released to the surroundings. The spring provides the function of a pressure relief valve. After the specified temperature and pressure have been achieved, the mould opens, the dies draw away from each other and the resulting hollow object is removed from the forming device.

OVERVIEW OF FIGURES IN DRAWINGS

Figure 2:
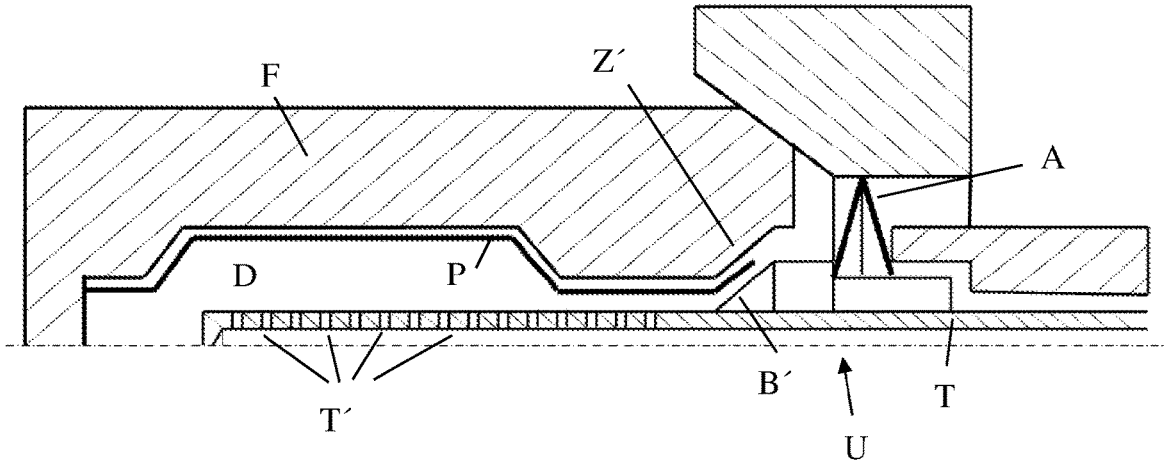

FIGS. 1 and 2 show a schematic depiction of a forming device for making hollow objects prior to the process and with a semi-finished product of the initial and final shapes, respectively.

EXAMPLE EMBODIMENT

A metal hollow semi-finished product P provided with one opening is made of the 25SiCrB material (Tab. 1). This semi-finished product P is heated approximately to its austenite temperature of 950° C. in an electrical furnace. Immediately after that, the semi-finished product P is transferred by means of tongs into a forming device. The forming device comprises a split mould F and a sealing feature U. A cavity D is created by bringing both parts of the mould F together, with their opening's entrance edge being provided with an expanded portion Z', against which the sealing feature U is oriented, whose outer surface B' is arranged to close against this expanded portion Z'. Bringing the sealing feature U into contact with the expanded portion Z' seals the cavity D. In the gap between the expanded portion Z' and the outer surface B' of the sealing feature U, part of the semi-finished product P becomes trapped which thereby perfectly seals the cavity D. The sealing feature U is provided with a tube T and a means of supply of water by which it extends into the cavity D of the mould and into the semi-finished product P. On its circumference, the tube T is provided with nozzles T'. In this case, the forming process in the forming device takes place with the aid of steam which creates internal pressure. The steam is generated by supplying water through nozzles T' in the tube T, as a consequence of the contact of water with the heated semi-finished product. By means of the internal pressure, the semi-finished product P is deformed into the final hollow object shape at temperatures in an interval of approximately 920° C. to 500° C. The final shape is obtained by filling the internal contour of the cavity D in the forming device. The sealing feature U is pressed against the mould F via a spring A, which rests on the outer surface B' of the sealing feature. When the maximum pressure is exceeded, said spring moves the outer surface B', which is arranged to close against the expanded portion Z' of the entrance edge of the opening of the mould F, away from this expanded portion Z' and the gap thus provided enables part of the pressurized steam to be released to the surrounding space. Thus, the spring A fulfils the function of a pressure relief valve. After the desired temperature and pressure have been achieved, the cavity D is opened, both parts of the mould F are drawn apart and the resultant hollow object is removed from the forming device and is subsequently cooled to the ambient temperature. After the forming process, when the temperature of the hollow object becomes equal to the temperature of the mould F, which is heated to approximately 250° C., the hollow object having the final shape is removed from the mould F and transferred into a heating device. In this case, the heating device comprises a continuous furnace at the temperature of 250° C. This temperature enables carbon redistribution, austenite stabilization and relieves stress in the microstructure. The hollow object is kept at 250° C. in the furnace for about 6 minutes. In the last step, the hollow object is removed from the heating device and cooled by means of a cooling device in still air to ambient temperature or to room temperature, in this case 20° C. In this case, the cooling device has the form of a cooling conveyor.

TABLE 1

Chemical composition of the material 25SiCrB (wt. %)

| C | Si | Mn | Cr | Mo | Al | Nb | P | S | Ni | Cu | B |
|---|---|---|---|---|---|---|---|---|---|---|---|
| 0.25 | 2.0 | 0.5 | 0.8 | 0.03 | 0.008 | 0.03 | 0.01 | 0.01 | 0.08 | 0.07 | 0.005 |

INDUSTRIAL UTILITY

This invention can be used in the production of metal parts, namely in the metallurgical industry in making semi-finished products, in particular for the automotive industry.

The invention claimed is:

1. A method of producing a shaped hollow metal object, the method comprising the steps of:

a) heating a hollow semi-finished metal product including a central space having an opening to an austenite temperature such that the hollow semi-finished metal product is in an austenite state;

b) placing the hollow semi-finished metal product into a cavity of a mould, the cavity having a shape corresponding to a desired findal external shape of the shaped hollow metal object;

c) sealing the opening of the hollow semi-finished metal product and the central space via a sealing feature biased by a spring;

d) introducing at least one of water and steam into the central space such that the hollow semi-finished metal product heats the at least one of water and steam thereby increasing pressure in the central space so that the hollow semi-finished metal product attains the desired final shape of the shaped hollow metal object via the shape of the cavity of the mould;

e) automatically unsealing the opening of the hollow semi-finished metal product when the pressure in the central space generates a counterforce that overcomes a threshold bias force of the spring; and f) removing the shaped hollow metal object from the cavity, wherein steps b)-f) are performed with the respective hollow semi-finished product or shaped hollow metal object being in the austenite state.

2. The method of claim 1, further comprising the steps of reducing a temperature of the hollow semi-finished metal product to be equal to a temperature of the mould via contact of the hollow semi-finished metal product with the mould before removing the shaped hollow metal object from the mould, maintaining thre temperature of the shaped hollow metal object at the equalized temperature for at least 5 minutes, and reducing the temperature of the shaped hollow metal object to ambient temperature via air cooling.

3. The method of claim 1, the mould being a split mould, the cavity including an entry edge having an expanded portion, step c) including pressing a proximal portion of the hollow semi-finished metal product against the expanded portion via an outer surface of a sealing feature, and step d) including introducing the at least one of water and steam through the sealing feature.

4. The method of claim 3, wherein step d) includes introducing the at least one of water and steam via a tube passing through the sealing feature.

5. The method of claim 4, wherein step d) includes evenly distributing pressure in the central space via nozzles circumferentially located on the tube.

6. The method of claim 3, further comprising the step of contacting an inner surface of the hollow semi-finished metal product only at the proximal portion via the outer surface of the sealing feature such that a remainder of the inner surface is uncontacted when step d) is initiated.

7. A method of producing a shaped hollow metal object, the method comprising the steps of:

a) heating a hollow semi-finished metal product including a central space having an opening to an austenite temperature such that the hollow semi-finished metal product is in an austenite state;

b) placing the hollow semi-finished metal product into a cavity of a mould, the cavity having a shape corresponding to a desired final external shape of the shaped hollow metal object;

c) contacting an internal surface of the hollow semi-finished metal product only at a proximal portion of the hollow semi-finished metal product via a sealing feature so as to seal the opening of the hollow semi-finished metal product and the central space, a remainder of the internal surface being uncontacted;

d) introducing at least one of the water and steam into the central space such that the hollow semi-finished metal product heats the at least one of water and steam thereby increasing pressure in the central space so that the hollow semi-finished metal product attains the desired final shape of the shaped hollow metal object;

e) unsealing the opening of the hollow semi-finished metal product; and f) removing the shaped hollow metal object from the cavity, wherein steps b)-e) are performed with the respective hollow semi-finished product or shaped hollow metal object being in the austenite state, wherein the sealing feature is biased by a spring and step e) includes automatically unsealing the opening when the pressure in the central space generates a counterforce that overcomes a threshold bias force of the spring.

8. The method of claim 7, further comprising the steps of reducing a temperature of the hollow semi-finished metal product to be equal to a temperature of the mould via contact of the hollow semi-finished metal product with the mould before removing the shaped hollow metal object from the mould, maintaining the temperature of the shaped hollow metal object at the equalized temperature for at least 5 minutes, and reducing the temperature of the shaped hollow metal object to ambient temperature via air cooling.

9. The method of claim 7, the mould being a split mould, the cavity including an entry edge having an expanded portion, step c) including pressing the proximal portion of the hollow semi-finished metal product against the expanded portion via an outer surface of the sealing feature, step d) including introducing the at least one of water and steam through the sealing feature.

10. The method of claim 9, wherein step d) includes introducing the at least one of water and steam via a tube passing through the sealing feature.

11. The method of claim 10, wherein step d) includes evenly distributing pressure in the central space via nozzles circumferentially located on the tube.

* * * * *